US005651199A

United States Patent [19]

Chaigne et al.

[11] Patent Number: 5,651,199

[45] Date of Patent: Jul. 29, 1997

[54] FLEXIBILTY ADJUSTMENT OF A SKI BOOT

[75] Inventors: Jerôme Chaigne, Saint-Jorioz; Jean-Pierre Clement, Annecy-Le-Vieux, both of France

[73] Assignee: Salomon S.A., Metz-Tessy, France

[21] Appl. No.: 494,875

[22] Filed: Jun. 26, 1995

[30] Foreign Application Priority Data

Jul. 7, 1994 [FR] France ..... 94 08772

[51] Int. Cl.[6] ..... A43B 5/04

[52] U.S. Cl. ..... 36/118.3; 36/118.2

[58] Field of Search ..... 36/121, 118.2, 36/118.3, 118.4, 118.5, 118.6, 118.7, 118.8, 118.9

[56] References Cited

U.S. PATENT DOCUMENTS

| | | | |
|---|---|---|---|
| 3,570,148 | 3/1971 | Morgan | 36/2.5 |
| 4,085,528 | 4/1978 | Delery | 36/121 |
| 4,379,370 | 4/1983 | Balbinot | 36/121 |
| 4,501,078 | 2/1985 | Kopp | 36/121 |
| 4,539,764 | 9/1985 | Pradier | 36/121 |
| 4,601,118 | 7/1986 | Zanatta | 36/121 X |
| 4,843,740 | 7/1989 | Walkhoff | 36/121 X |
| 4,864,744 | 9/1989 | Walkhoff | 36/121 X |
| 4,922,632 | 5/1990 | Arieh et al. | 36/118.4 |
| 4,932,143 | 6/1990 | Benetti | 36/120 |
| 4,934,075 | 6/1990 | Benetti et al. | 36/120 |
| 5,379,531 | 1/1995 | Iwama | 36/50.5 X |
| 5,501,023 | 3/1996 | Miotto | 36/50.5 |

FOREIGN PATENT DOCUMENTS

| | | |
|---|---|---|
| 0358599 | 3/1990 | European Pat. Off. . |
| 0364398 | 4/1990 | European Pat. Off. . |
| 0368797 | 5/1990 | European Pat. Off. . |
| 2682859 | 4/1993 | France . |
| 2693086 | 1/1994 | France . |
| 3116841 | 3/1982 | United Kingdom . |

OTHER PUBLICATIONS

*Dynafit* Catalog, 1983, pp. 2 and 3, and an English language translation of textual portions.

*Primary Examiner*—Ted Kavanaugh

*Attorney, Agent, or Firm*—Greenblum & Bernstein, P.L.C.

[57] ABSTRACT

The invention relates to a ski boot in which the shell base includes a single abutment, adjustable in position, with which cooperates the upper for its rearward support and its retention in front inflexion by means of the ends of an oblong slot and a movable element. This movable element, mounted on the upper in combination with the single abutment, provides, at will, the latching of the upper by adjustment under the abutment, or the unlatching of the upper in forward flexion alone, and along a predetermined amplitude by retraction of the abutment.

14 Claims, 7 Drawing Sheets

15'
15
3
6
91
11
9
93
92
90
5
18
14
16
17
10
8
12
7
4
1
2
13
19
9
93
11
92
13
12
10

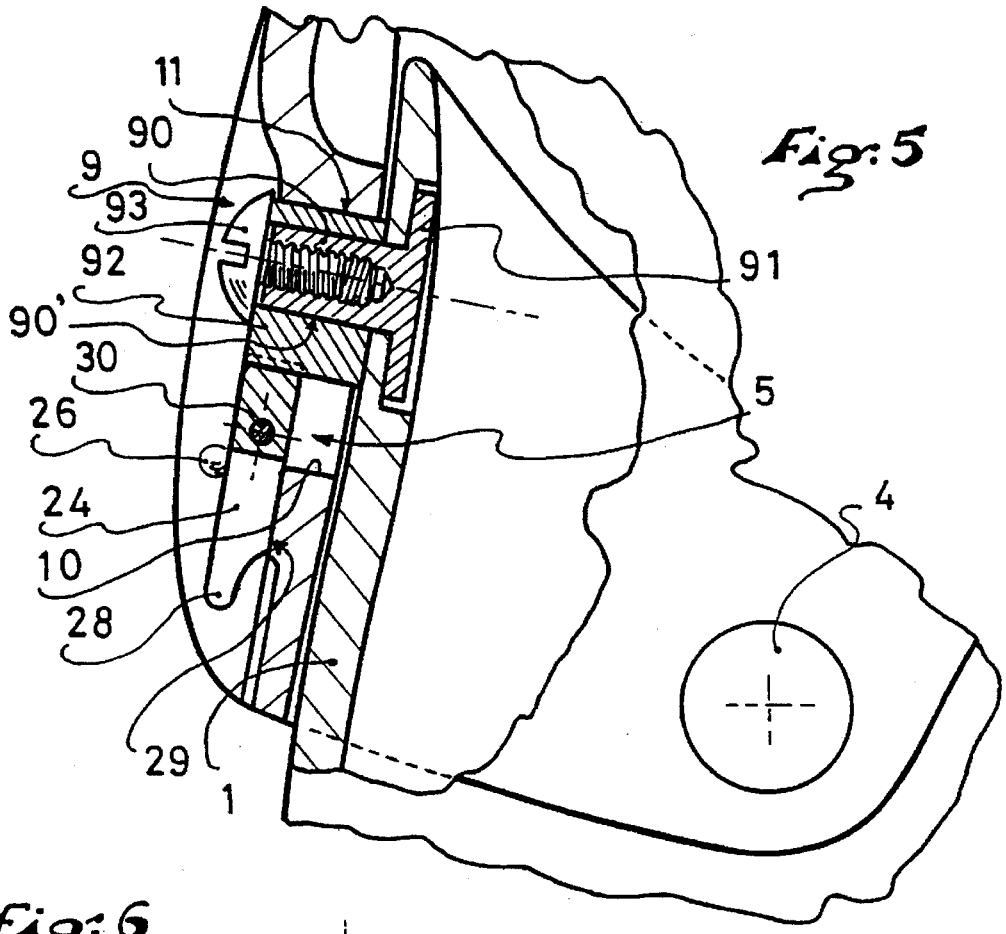
Fig: 5
Fig: 6
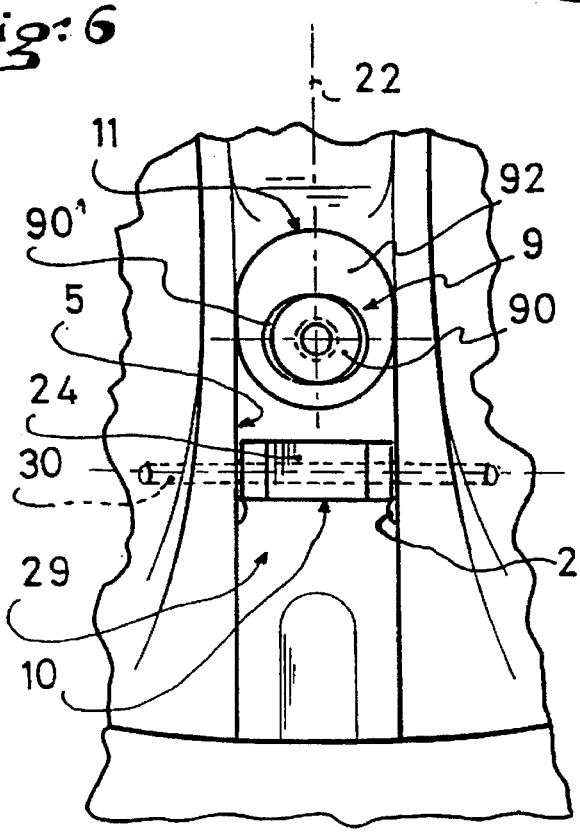
Fig: 7
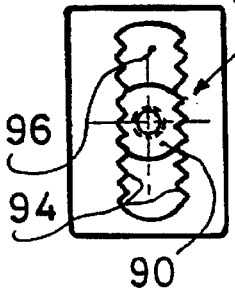
Fig: 8
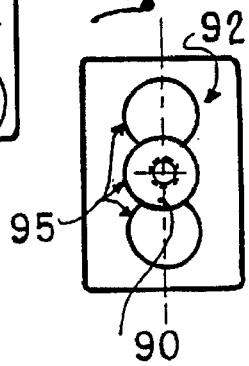

FLEXIBILTY ADJUSTMENT OF A SKI BOOT

BACKGROUND OF THE INVENTION

1. Field of the Invention

The present invention relates to a ski boot composed of a shell base beneath an upper journalled on the shell base, and whose portion situated in the zone of the heel comprises en oblong slot which cooperates with a support abutment positioned on the shell base, a latching element being adapted to obstruct the slot to block the upper relative to pivoting.

2. Description of Background and Material Information

A boot of this type is described in French Patent application 2,682,859. According to this document, the support abutment, attached on the shell base, is constituted by a fixed portion and a movable portion adjustable and positioned by means of manual control means interacting between the two portions of the abutment; as a function of the spacing of these portions, defined by the control means, the support abutment in its entirety occupies more or less the oblong slot and proportionally limits the possible back and forth movement of the slut with respect to it, and thus the flexional possibilities of the upper. In this type of boot there is likewise provided that, in a position of maximum spacing of the movable portion of the abutment from that which is fixed, that the oblong slot can be totally occupied by these portions of the abutment so as to block the upper growth as much with respect to frontward flexion as well as rearward flexion. The movable portion of the abutment associated with its control means thus constitutes the latching element strictly speaking of the upper, and allows, selectively, for the modification of the flexibility of the upper in amplitude; as a result of this construction, the flexibility which may be given to the upper is essentially a function of the maximum displacement which the control means can produce, end this, within the strict limit of the length of the oblong slot. Such limitations prove troublesome because, to take advantage both of a substantial possibility of flexion and a blockage position, it is necessary to simultaneously provide a large slot end control means capable of producing a substantial displacement of the movable portion of the abutment. In fact, there cannot be independence of construction between the means adapted to assure the blockage function and those adapted to define the amplitude of flexion of the upper.

Still within the same document, it is provided that the support abutment is affixed in a movable fashion on the shell base, by means of a screw, and can be positioned at will over one or more orifices provided in the shell base concentrically to the journal axis of the upper. These orifices are provided at a distance from one another for a certain angular value defining, each one, an advancement angle of the upper. As a result of such a construction the adjustment of the advancement angle cannot be performed until after the support abutment has been taken apart in its entirety then repositioned in the appropriate orifice, which is tedious to perform. In effect, in the present case, the extraction of the liner or of the interior comfort padding is necessary in order to reach the screw which is accessible only from the interior of the boot, the portion of the support abutment accessible from the exterior being previously occupied by the manipulation element of the control means of the movable portion of the support abutment.

Finally, if utilizing such an adjustable support abutment in an oblong slot provides a blockage position or a possibility of flexion of the upper to a predefined amplitude, it is not provided with a shock absorption element adapted to progressively brake this flexion, and the activation of such an element appears random. In effect, the fixed and movable portions of the support abutment each serve as a stop element at the corresponding end of the oblong slot, it is not designed to interpose a shock absorption element between it and the ends of the oblong slot without adversely affecting the quality of latching of the upper when the abutment is brought to the blockage position.

SUMMARY OF THE INVENTION

The present invention serves to overcome the various disadvantages noted above and proposes a shoe in which the shell base comprises a single abutment which is accessible in position in the zone of the heel, and with which cooperates the upper for its rear support and its retention in forward flexion, a movable element mounted on the upper and combined with the single abutment being adapted to achieve, at will, the latching of the upper or the unlatching thereof in frontward flexion alone, and at a constant predetermined amplitude with or without shock absorption.

According to the invention, the ski boot comprises an upper, made out of one or more portions, mounted at least partially to pivot on a shell base around a journal and linkage axis, the upper cooperating for its rear and front support with a single support abutment which, positioned adjustably at a height on the shell base in the zone of the heel, projects to extend in a vertical oblong slot formed in the wall of the upper positioned facing it. The lower and upper ends of the oblong slot are spaced such that they define between them a greater space than the space occupied by the adjustable abutment, thus allowing for a relative displacement of the slot with respect to the shell base, the upper end of the slot coming, in the initial position of skiing, into support on the adjustable abutment to constitute the rear support of the upper and thus define the selected advancement angle thereof. According to one characteristic, a movable element mounted on the upper is adapted to at least partially block the space left free between the lower end of the slot and the adjustable support abutment for a latching position of the upper with respect to the shell base. In this position the movable element engages itself in an adjustable manner under the support abutment. Likewise, the movable element is also adapted to retract from the oblong slot through action of a manipulation element to achieve an unlatching position of the upper which is then allowed to pivot on its general axis alone towards the front of the boot. The amplitude of pivoting thus allows to correspond to at least the value of the space freed by the movable element, and at a maximum at the far extent of the space included between the adjustable abutment and the lower end of the oblong slot. It is evident that the portion of the movable element which engages in an adjustable manner under the support abutment to produce the latching of the upper is obtained by a non-warping rigid material.

According to the invention, the combination of a single support abutment for the upper, which is adjustable in position to modify the advancement angle thereof, with a movable latching-unlatching element positioned on the upper, makes it possible to guarantee the constancy of possible back and forth movement of the oblong slot with respect to the support abutment. In effect, whatever the advancement adjustment achieved by means of the support abutment, in fact the adjustment of the rear support of the upper, one simultaneously displaces the elements adapted to achieve the front support whether it be the movable element when it assumes a partially retracted position or the lower end of the oblong slot when the movable latching-unlatching element is totally disengaged from the slot.

According to one embodiment, the support abutment is positioned on the shell base by means of a fixed nipple, and its adjustment in translation in the vertical direction occurs by means of an oblong element, provided with an eccentric hole, which is mounted and blocked thereon for example by a screw. The oblong element, whose exterior profile corresponds substantially to the width of the oblong slot obtained in the upper, can thus be turned 180 degrees on the nipple, which causes two variations of its relative position on the shell base, and, consequently, provides two possibilities of adjustment of the advancement angle of the upper. In another embodiment, the oblong element of the support abutment is provided with an oblong slot which renders it adapted to slide on the nipple when its blockage screw is unscrewed. The oblong element can thus be adjusted in height on the shell base to cause a plurality of advancement angles in the limits defined by the length of the oblong slot, and this, without there being modification of the possibilities of forward flexion of the upper, are duty, but the possible back and forth movement of the slot with respect to the abutment romaine constant.

Other embodiments of the adjustment means of the oblong element on the nipple can likewise be used. For example, the nipple can be obtained with at least one lateral gear adapted to cooperate with a corresponding gear formed on one of the sides of the oblong slot. The adjustment of the oblong element, and thus the advancement angle of the upper, oppose "tooth by tooth". Further, the nipple can be provided with a cylindrical cross section and the oblong element of the abutment with a succession of holes corresponding to the cylindrical cross section of the nipple, the holes being secant between them in the longitudinal direction of the oblong element. The adjustment of the oblong element occurs in this case by passing from one hole to another in the same fashion as with the gear system previously described.

These embodiments of the adjustment means of the support abutment which have just been described by way of example have the advantage of being accessible and maneuverable from the exterior of the boot, but nevertheless are not intended to exclude the possibility of utilizing adjustment means which are maneuverable from the interior.

According to one embodiment, the movable latching-unlatching element occupies the entire space included between the lower end of the oblong slot formed in the upper and the support abutment. In this case, the possibility of flexion of the upper is limited in the value to the freed space allowed by the movable element when it is brought to the unlatching position.

An alternative embodiment comprises forming an oblong slot which is greater than the space occupied by the support abutment and the movable latching-unlatching element. Thus, when the movable element is unlatched, the upper of the boot can flex forwardly by a greater value than the space previously occupied by the movable element, and at a maximum to the full extent of the space included between the support abutment and the lower end of the oblong slot.

To pass from a latching position to an unlatching position, the movable element can equally be mounted to turn on a pivot axis or be translationally displaced. Immobilization means and/or retention means in one and/or the other of its latching-unlatching positions are then preferably provided. These means, which can be constituted by nesting or elastic ratcheting means, for example, are positioned to interact between the movable element and its manipulation element between the movable element and the upper, or between the manipulation element of the movable element of the upper.

Another alternative embodiment of the movable element for latching-unlatching is to provide it with a rigid portion and a shock absorption portion, for example which is elastically compressible, the latter being adapted to substitute itself for that of rigid material which causes the latching when the movable element is brought into the unlatched position. By this construction, the upper of the shoe can be latched in its year support position on the abutment of the shell base, or be unlatched in frontward flexion along a predetermined amplitude, and with a certain shock absorption provided by the ability to deform elastically the shock absorption portion with which the movable element is provided.

Likewise, the amplitude of frontward flexion of the upper of the boot and its shock absorption can be obtained by means of an elastically compressible means which is simply introduced between the support abutment and the lower end of the oblong slot while allowing for a free space which, positioned under the support abutment, is adapted to be occupied by the movable latching-unlatching element when it is in the active latching position. By virtue of this construction one thus benefits from the advantage of more room to provide a shock absorption over an amplitude of pivoting of the upper which is relatively substantial.

BRIEF DESCRIPTION OF THE DRAWINGS

The invention will be better understood with reference to the description which follows, given with reference to the annexed schematic drawings which are byway of example only, of a number of embodiments of the boot, in which:

FIGS. 3, 4 and 5, illustrate, seen in detail, one embodiment of the structure and manipulation of a single support abutment with a latching element turnably mounted on the upper of the boot.

FIG. 6 illustrates a second position of adjustment of the support abutment of FIGS. 3, 4 and 5.

FIGS. 7 and 8 represent two different embodiments of the means for activation to adjust the position of a support abutment.

DETAILED DESCRIPTION

Figures 1, 2, 2A:
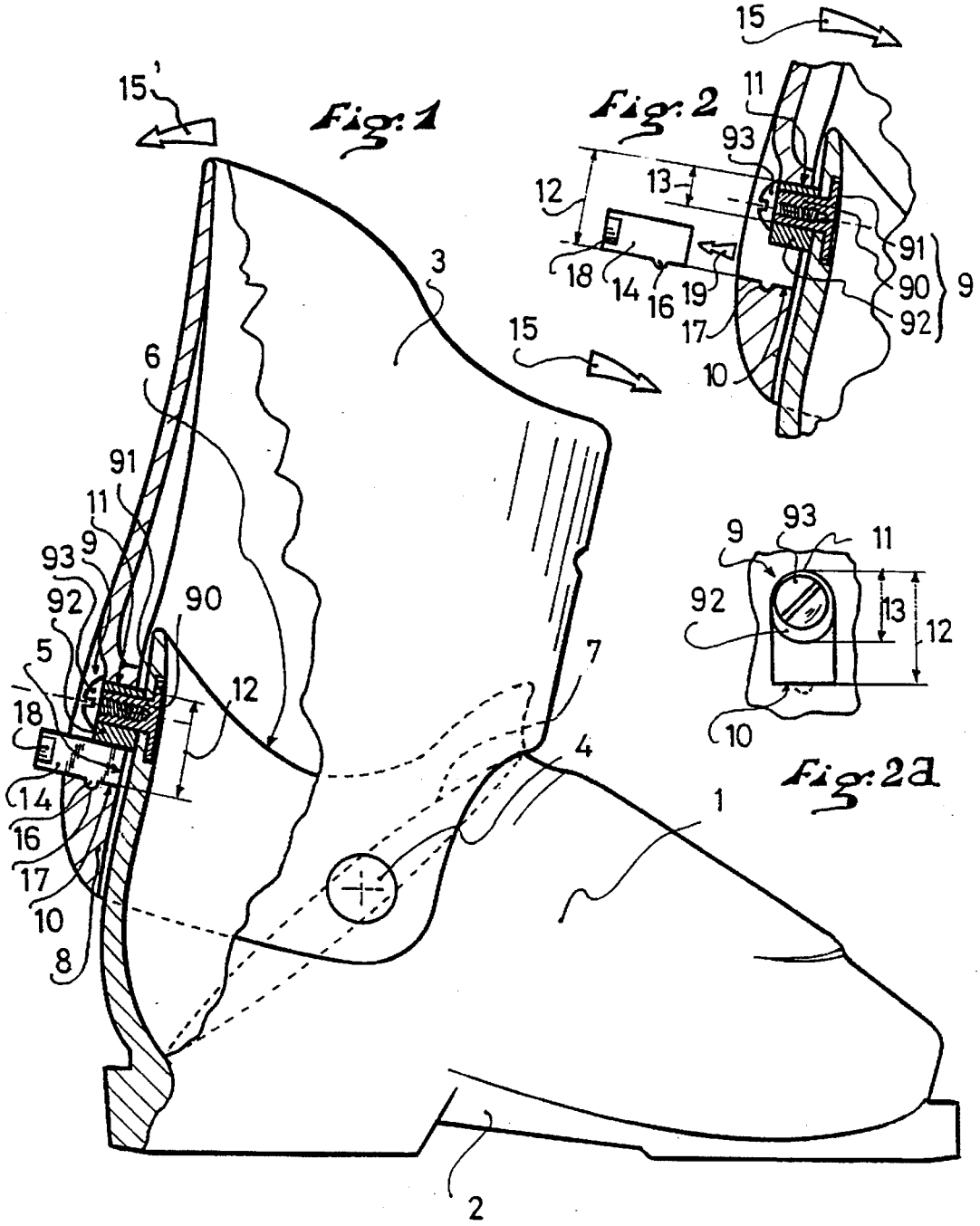
FIG. 1 illustrates, an elevational view and in partial cross section, a ski boot according to the invention provided in the zone of the heel with a single abutment for rear and front support of the upper mounted in combination with a latching-unlatching element of the upper.
FIGS. 2 and 2*a* show a detail of the zone of the heel of the boot of FIG. 1 when the upper is unlatched.

The shoe of FIG. 1 is constituted, as is known, with a shell base 1 provided with a sole 2 and an upper 3 which, in the present case, is made from a single tubular part that surrounds corridor around the lower leg of the skier, the lower leg not shown. This upper can be formed out of a plurality of parts, for example with a real spoiler and a cuff as is commonly utilized in boots of the rear entry or central entry type.

Upper 3 is mounted in a pivotable manner on shell base 1 bye linkage or journal axis 4, and at least partially covers, over its lower edge, the upper opening 6 of the shell base positioned above the zone which corresponds to the entry perimeter of the ski boot, schematically shown in dashed lines and identified by numeral 7. In the zone of the heel of shell base 1, a single abutment 9 is adjustably mounted in height and extends to project into a vertical oblong slot 5 formed in the wall 8 of the upper 3 positioned directly opposite the lower end 10 and upper end 11 defining a space 12 which is greater than space 13 occupied by abutment 9, so as to allow for a relative displacement of the slot 5 with respect to the latter, and thus the upper 3 with respect to the shell base 1.

In the initial position of skiing. FIGS. 1 and/or 2, the upper 3 is prevented from any pivoting 15' directed towards the rear because it is supported directly on the abutment 9 through the upper end 11 of its slot 5. Abutment 9 thus constitutes the reference element to define the advancement angle of the upper 3, and its adjustment in height so as to allow for modification at will of this advancement angle while preserving the same possibility of back and forth movement between them and the slot 5 because the latter is displaced simultaneously with the abutment 9. This possibility of abutment given from the rear support position of the upper on abutment 9 is thus always directed towards the front of the boot as shown by arrow 15. A movable element 14 movably mounted on upper 3 and manipulable by its end 18 which is accessible from the exterior of the boot is adapted, in combination with the slot 5 and the support abutment 9 to, in a position illustrated in FIG. 1, block the space left under the latter and above the lower end 10 of the flat 5, and thus to obtain the latching of the upper in rearward support on shell base 1. It is clear that the movable element 14 is formed out of an essentially rigid material if one desires a tight latching. In this latched position, the upper 3 is prevented from any pivoting around its journal axis 4, and the resistance which it opposes during skiing causes a quasi-instantaneous and powerful transmission of the forward and rearward support of the lower leg of the skier, which is desirable in competition skiing, for example. Conversely, in the unlatched position, as shown in FIGS. 2 and 2*a*, upper 3 is adapted to be able to flex forwardly along 15 to the end of the free space by virtue of movable element 14, and to the maximum until the lower end 10 of the slot 5 is supported against abutment 9. This flexibility Of predefined amplitude allows upper 3 of the boot to pivot frontwardly while slightly delaying the transmission of the support of the lower leg of the skier, and thus conferring to the boot greater flexibility, which is desirable for leisure skiing.

So as to guarantee a stable position for the movable element 14 latched on upper 3, elastically nestable means such as a projection 16 and a depression 17 are formed between the movable element 14 and its seat on upper 3. In the embodiment which has just been described with reference to FIGS. 1, 2 and 2*a*, the movable element 14, schematically shown in the form of a pivot or movable bar 5, must necessarily be extracted 19 in its entirety from its seat in the upper 3 to provide unlatching thereof, FIG. 2.

With reference to FIGS. 3–6, it is also possible to provide a latchable movable element 24 which is simply partially retractable. In this embodiment, the movable element 24 is turnably mounted on a pivot axis 30 transverse to the longitudinal axis 22 of the oblong slot 6 and its respective latching-unlatching positions are defined by the lower end 10 of slot 8, and by a support zone 29 perpendicular to the end 10.

Figure 3:
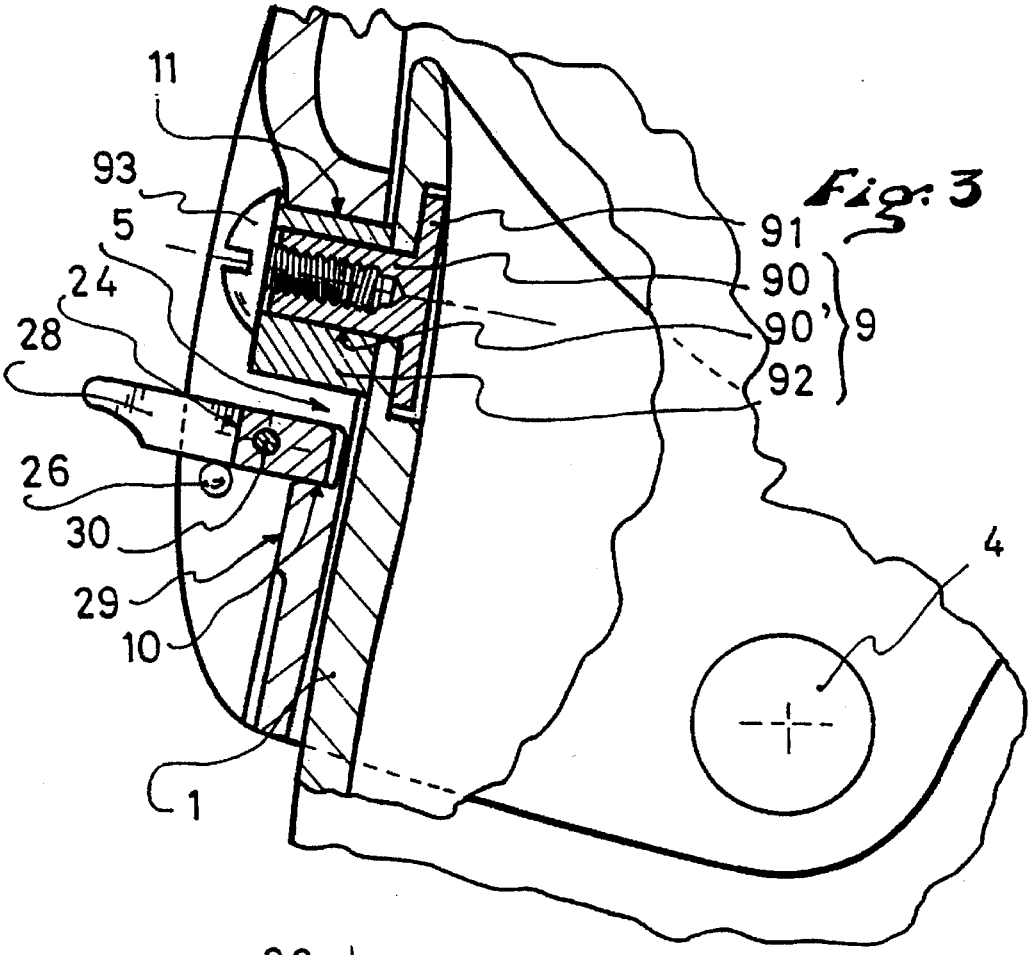
Figure 4:
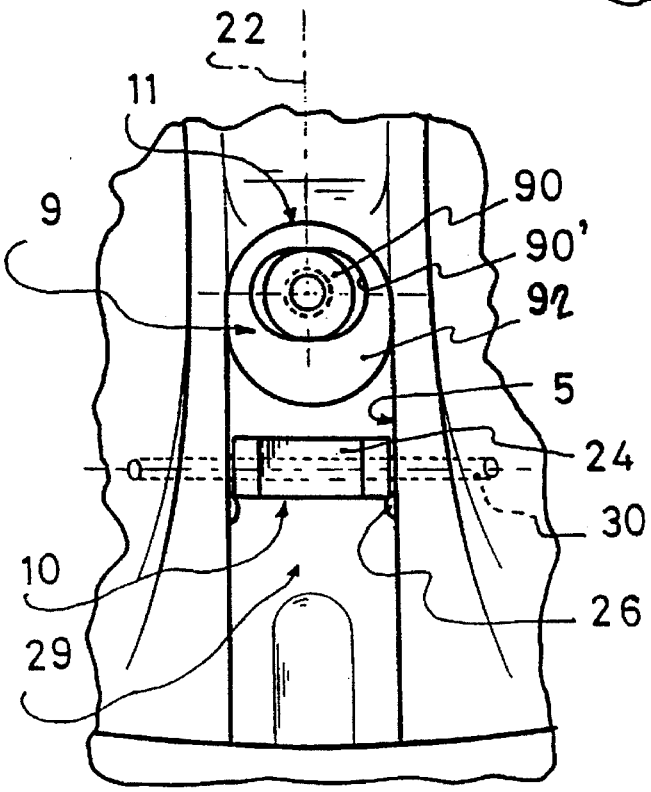

Thus, the movable element 24 is adapted to be able to pivot by 90 degrees on its axis 30 with the assistance of its manipulation end 28, and thus to block the upper by adjusting itself under abutment 9, FIG. 5, or to partially retract from slot 5, FIGS. 3 and 4.

An elastic ratcheting system constituted by a projection 26 which cooperates with the sides and the edges of the movable element 24 retains the latter in each of its extreme positions, i.e., of latching and unlatching. As in the preceding case, support abutment 9 is positioned on shell base 1 in the zone of the heel and is adapted to adjust in height. To this end, it is constituted by a nipple 90 mounted and immobilized on the wall of shell base 1 by its base 91, and an oblong element 92 provided with an eccentric hole 90' which is mounted and blocked on the projection 90 with the assistance of a screw 93. Thus, from a first position where oblong element 92 is oriented with its thinner wall upwardly, as is seen in FIGS. 1–5, one can obtain a second position by a simple turning of the oblong element 92 by 180 degrees, the thinner wall then being oriented downwardly, as shown in FIG. 6. By varying the position of this oblong element 92 by 180 degrees, one can thus situate the support zone of the upper end 11 of oblong slot 5 on abutment 9 to two different heights with respect to shell base 1.

In the embodiment of FIGS. 7 and 8, the oblong element 92 of abutment 9 is made adjustable in height on shell base 1 with more than two positions. In FIG. 7, the oblong element 92 comprises an oblong hole 96 which is toothed on its sides 94, and mounting nipple 90 on shell base 1 is made with corresponding teeth in the zones which face one another. Thus, it is possible to displace, in a selective manner, "tooth by tooth", the oblong element 92 and thus to adjust advancement angle of upper 3 with several intermediate positions.

In FIG. 8, oblong element 92 of abutment 9 is achieved simply with three successive holes 95 corresponding, each, to the passage of mounting nipple 90. In this case, one has three height positions of the oblong element 92, and consequently three adjustment positions of the advancement angle of the upper 3 of the boot.

Figures 9, 10, 11:
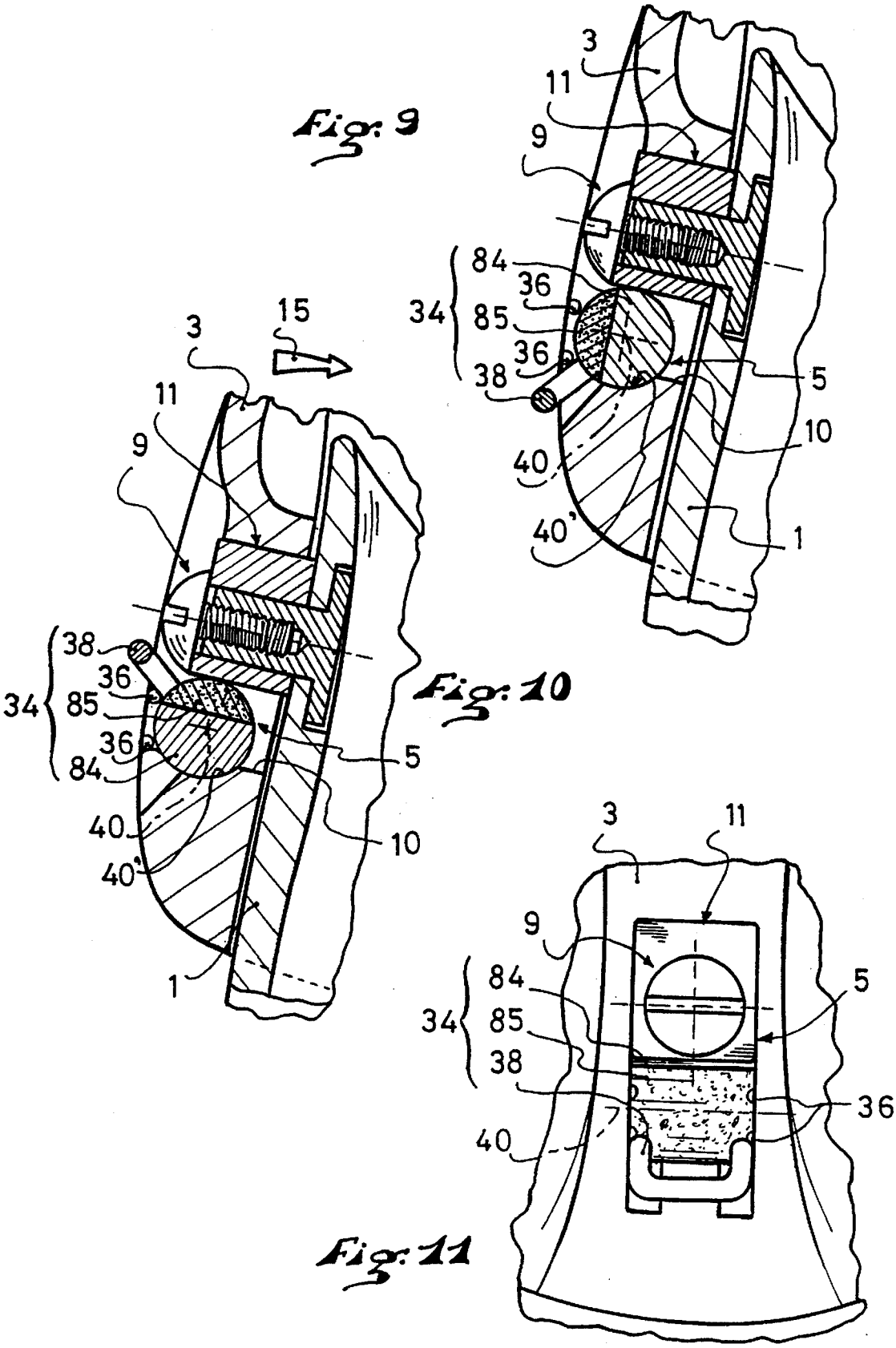
FIGS. 9, 10 and 11 show another embodiment of a latching-unlatching element turnable mounted on the upper of the boot in its two positions of operation.

FIGS. 9, 10 and 11 illustrate another embodiment of a movable element 34 which is partially retractable by action on its manipulation end 38. To this end, element 34, turnably mounted in seat 40' of upper 3 around a pivot axis 40, has a rigid portion 84 and a shock absorption portion 85. Thus, in the latching position, FIGS. 9 and 11, the rigid portion 84 caps or blocks the free space between the lower end 10 of oblong slot 5 by adjusting itself under support abutment 9. Conversely, in the unlatching position, illustrated in FIG. 10, element 34 is pivotable by approximately 90 degrees around its axis 40, and it is the shock absorption portion 85 which, substituting itself for the rigid portion 84, adjusts itself under abutment 9. Upper 3 of the boot is then adapted to flex, in the direction indicated by arrow 15, frontwardly, on the one hand over an amplitude determined by the compressibility of the shock absorption portion 85, and on the other hand, with a certain shook absorption function of the elastic resistance of portion 85. Preferably, elastic latching systems or means such as projections 36 are formed on upper 3 on the edges of slot 5, such that they block the manipulation end 38 of movable element 34 which passes between them, either in the upper position, FIG. 10, or in the lower position, FIGS. 9 and 11.

Figure 12:
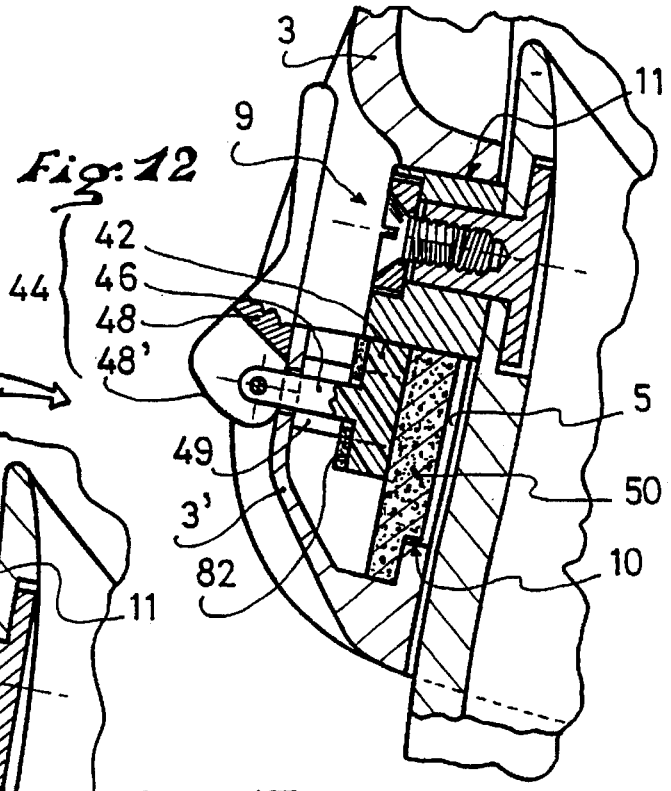
FIGS. 12 and 13 illustrate one embodiment of a latching-unlatching element which is translationally displaceable under the support abutment, and associated with a shock absorption means for the frontward flexion of the upper.
Figure 13:
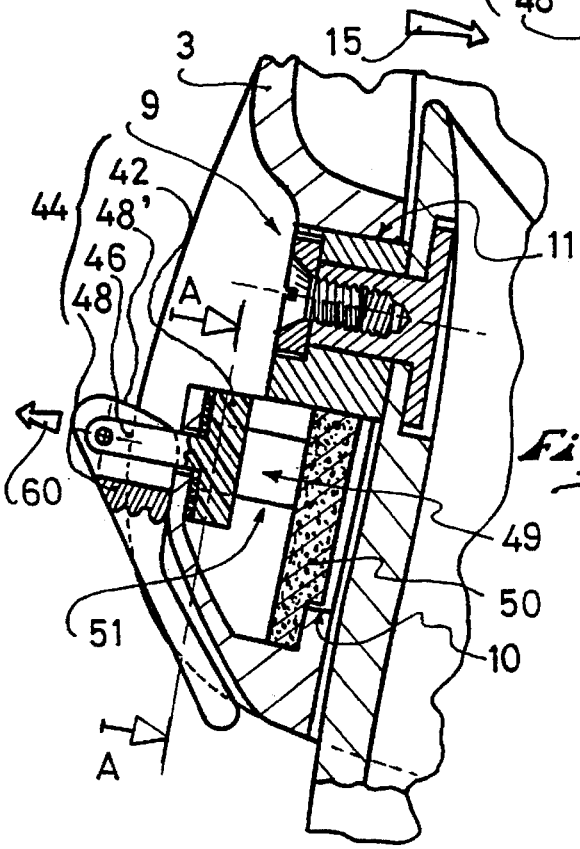
Figure 14:
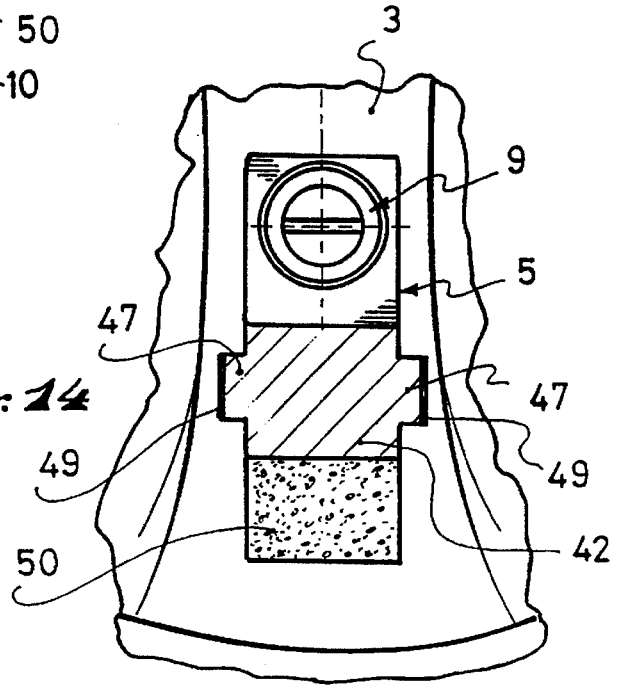
FIG. 14 illustrates, An cross section along line AA of FIG. 13, the transverse guidance of the latching-unlatching element.

In FIGS. 12, 13 and 14, movable element 44 is made retractable from slot 5 from its latching position (FIG. 12) by translational displacement in a direction 60 which is substantially perpendicular to the wall of upper 3 (FIG. 13). The translational guidance of movable element 44 is achieved by means of two tenons 47, with which it is provided, which slide in two complementary grooves 49 provided on the edges of slot 5. Its displacement is caused by means of its manipulation end 48 constituted by a cam lever 48' journalled on a finger 46 made of its rigid latching portion 42, and its retention in the latched position occurs by means of an elastically compressible means 82 which tends to maintain cam 48' pressed against wall 3' of upper 3. In this embodiment, the oblong slot 5 is made bigger than the space occupied by support abutment 9 with rigid portion 42 of movable element 44 when it is in the latching position, FIG. 12. Thus, by placing the latter in the unlatching position, FIG. 13, upper 3 is adapted to pivot frontwardly along direction 15 by turning on its journal and linkage axis with shell base 1, over a pivoting amplitude greater than the space freed up by rigid portion 42 of the said movable element 44.

Preferably, an elastically compressible means 50 can be positioned between the support abutment 9 and lower end 10 of slot 5, while leaving a space 51 free which corresponds to that which must be occupied by the rigid end 42 of movable element 44 in the latching position. One thus obtains a construction according to which upper 3 of the boot can be at will latched in its rear support position, or unlatched in frontward flexion with a greater possibility of simultaneous back and forth movement with a certain shock absorption.

Figure 15:
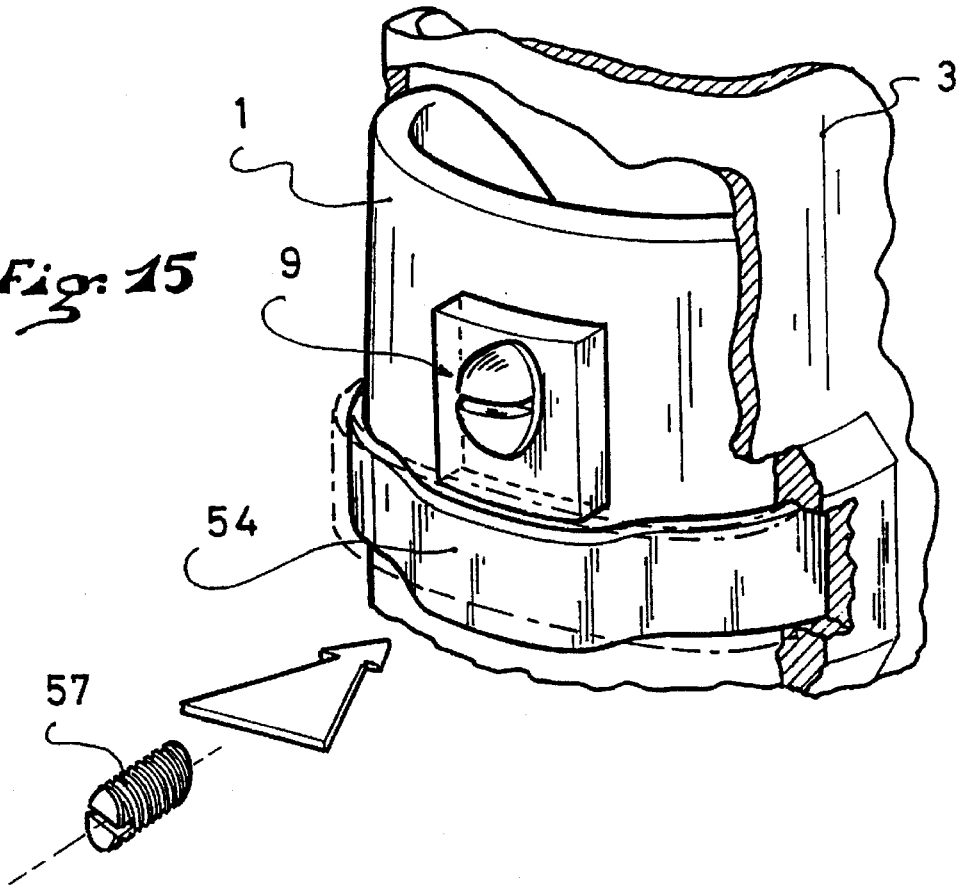
FIGS. 15 and 16 illustrate, schematically, another embodiment of a latching-unlatching element which is displaceable in translation under the support abutment.
Figure 16:
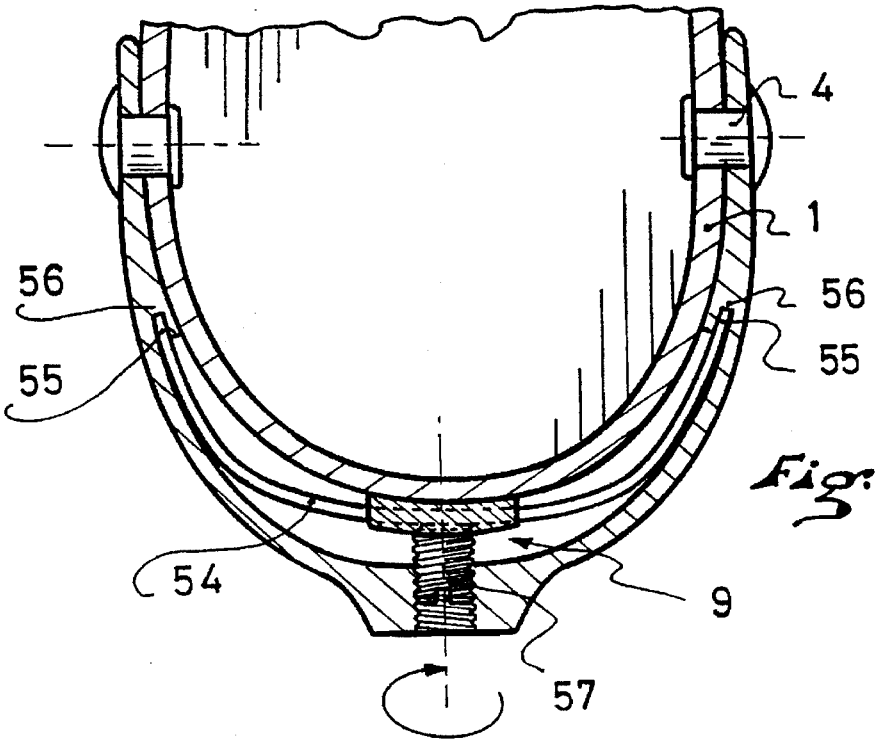
Figure 17:
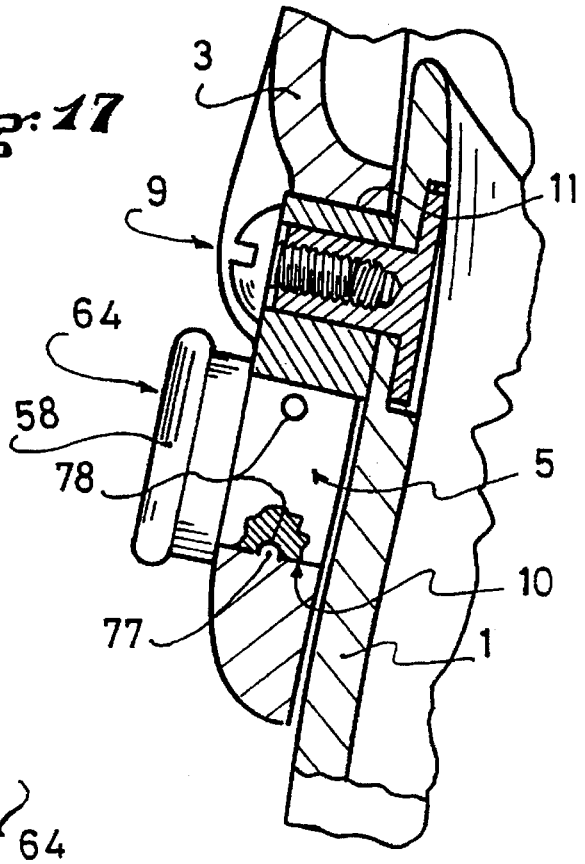
FIGS. 17, 18, 19 and 20 illustrate a latching-unlatching element which is displaceable in translation and provided with a shock absorption means of inflexion of the upper of the boot.
Figure 18:
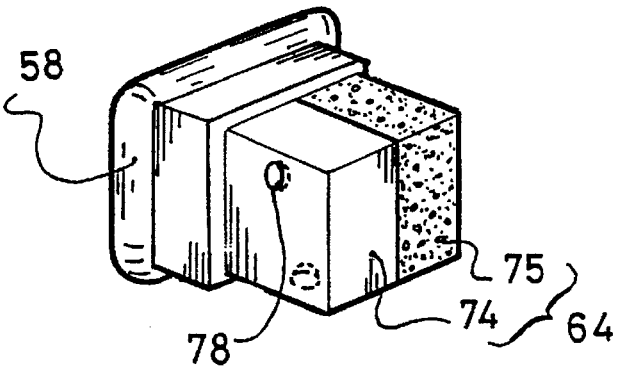
Figure 19:
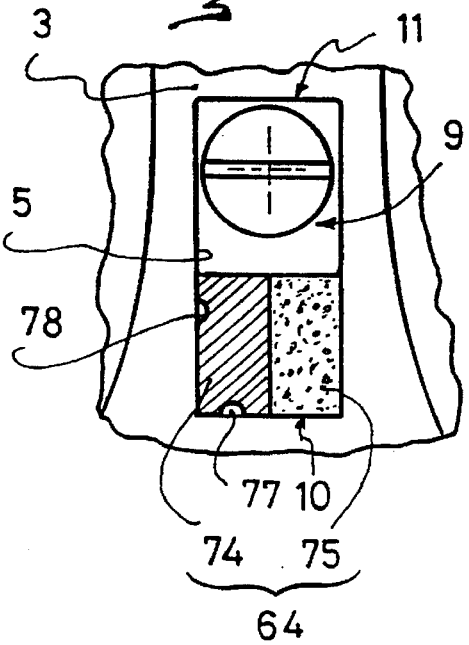
Figure 20:
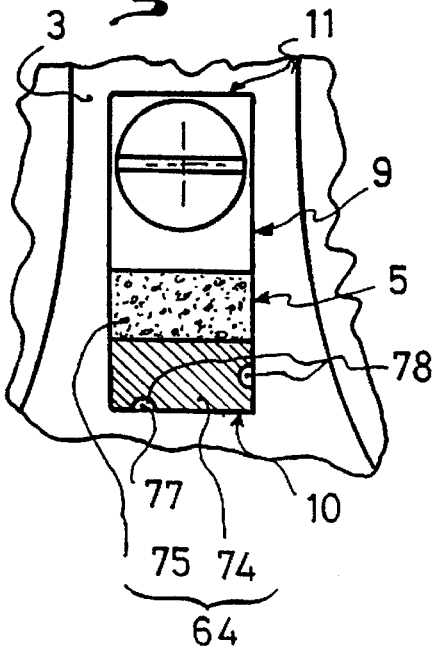

FIGS. 15 and 16 illustrate an embodiment of the movable latching element 54 which, made displaceable in translation to achieve the latching of the upper 3, is constituted by a blade spring in the form of the arc of a circle which extends transversely to the longitudinal axis of slot 5 (not shown), and which is positioned edgewise under abutment 9.

Element 54, whose two ends 55 are supported on shoulders 56 extending from upper 3, is preformed in a manner so as to be automatically disengaged from abutment 9 when its manipulation element 57, such as a screw, is brought to the unlatching position. To come to the latching position, it then suffices to tighten screw 57 against the central portion of spring blade 54 which is placed under abutment 9 by causing the flexion of the lateral zones of the said blade spring 54.

FIGS. 17, 18, 19 and 20, schematically illustrate one embodiment of a movable element 64 of the same type as that of FIGS. 1 and 2 and comprises a manipulation element 58, but provided with 8 rigid portion 74 and a shock absorption portion 75. This element is inserted, as described previously, between the support abutment 9 and the lower end 10 of oblong slot 5, the upper 3 of the boot being supported on the abutment 9 through upper end 11 of slot 5. Projections 77 adapted to cooperate with corresponding hollows 78 are formed between the movable element 64 and the upper 3, making it possible to retain the element 64 on the latter, either in the latching position, shown in FIGS. 17 and 19, or in the unlatching position, shown in FIG. 20. In this latter position, upper 3 is adapted, as in the example of FIGS. 9, 10 and 11 where element 34 is rotatable, to flex forwardly over an amplitude and with a certain predetermined shock absorption by virtue of the characteristics of the material constituting the chock absorption portion 75.

If is of course understood that other embodiments of the support abutment and/or the movable latching-unlatching element can be envisioned. For example, the support abutment can be made adjustable in position on shell base 1 in the zone of the heel by means of a screw which one engages in one of a plurality of holes obtained in the wall even of the shell base, or obtained in an insert applied to the wall.

The instant application is based upon French Patent application 94.08772, filed Jul. 7, 1994, the priority of which is hereby claimed and the disclosure of which is hereby incorporated by reference thereto.

Finally, although the invention has been described with reference to particular means, materials and embodiments, it is to be understood that the invention is not limited to the particulars disclosed and extends to all equivalents within the scope of the claims.

What is claimed is:

1. A ski boot comprising:

a shell base having a heel zone;

an upper connected to said shell base for enabling forward and rearward flexing of said upper with respect to said shell base;

a single abutment affixed to said shell base in said heel zone, said abutment being mounted for positional adjustment;

said upper being cooperable with said abutment for rear support of said upper and for retention of said upper during forward flexion;

a movable element mounted for movement on said upper, said movable element being cooperable with said abutment to selectively latch said upper with respect to said shell base, in a latching position of said movable element, and to unlatch said upper during said forward flexing regardless of said positional adjustment of said abutment, in an unlatching position of said movable element;

a journalled connection between said upper and said shell base for enabling a pivoting of said upper with respect to said shell base; and an oblong vertical slot in a wall of said upper, said oblong vertical slot having a lower end an upper end;

said abutment extending outwardly from said shell base and into said oblong vertical slot, said distance between said lower end and said upper end of said oblong vertical slot being greater than a dimension of said abutment to thereby allow for a relative displacement of said oblong vertical slot with respect to said abutment and, therefore, to thereby allow for a relative displacement of said upper with respect to said shell base, said upper end of said oblong vertical slot being in engagement with said abutment for constituting rearward support of said upper and, thereby, to define an advancement angle of said upper.

2. A ski boot according to claim 1, wherein:

said movable element being adapted to be moved into said latching position in a free space beneath said abutment and above said lower end of said oblong vertical slot to at least partially block said upper during pivoting of said upper with respect to said shell base;

said movable element being adapted to be moved into said unlatching position to allow said relative displacement of said upper and said oblong vertical slot with respect to said abutment forwardly within an amount defined by a space between said abutment and said lower end of said oblong vertical slot; and a manipulation member for moving said movable element between said latching position and said unlatching position.

3. A ski boot according to claim 1, wherein:

said movable element for latching and unlatching said upper is made of a substantially rigid material.

4. A ski boot according to claim 1, further comprising:

an elastically compressible means positioned in said oblong vertical slot beneath said abutment and said lower end of said oblong vertical slot by providing a free space beneath said abutment adapted to be occupied by said movable element.

5. A ski boot according to claim 1, wherein:

said movable element comprises a portion made of a rigid material and a portion made of an elastically compressible material;

in said latching position, said rigid portion of said movable element extends between and is in engagement with said abutment and with said lower end of said oblong vertical slot, said rigid portion of said movable element thereby being in an active position and said elastically compressible portion being in an inactive position; and in said unlatching position, said rigid portion of said movable element is removed from engagement from said abutment and said elastically compressible portion of said movable element is positioned in engagement with said abutment, said elastically compressible portion thereby being in an active position.

6. A ski boot according to claim 1, further comprising:

means for mounting said movable element for rotational movement on said upper between two angular positions, one position being a latching position and a second position being an unlatching position.

7. A ski boot according to claim 1, further comprising:

means for mounting said movable element for translational movement on said upper including a guide oriented substantially perpendicularly with respect to said oblong vertical slot; and a manipulation element for moving said movable element, said manipulation element having an eccentric cam journalled on said movable element.

8. A ski boot according to claim 1, wherein:

said movable element is an elastically deformable blade having an arcuate shape, said blade extending transversely to said oblong vertical slot, said blade having a central portion with an edge of said central portion positioned lower than said abutment;

said ski boot further comprising a manipulation element having means for pushing said central portion of said blade, by deforming said central portion of said blade, into said oblong vertical slot and causing an engagement of said central portion of said blade with said abutment in said latching position of said movable element and for reversing said deformation of said central portion of said blade and withdrawing said central portion of said blade from said oblong vertical slot.

9. A ski boot according to claim 1, further comprising:

immobilizing means for securing said movable element in at least one of said latching position and said unlatching position is associated with said movable element.

10. A ski boot according to claim 9, wherein:

said immobilizing means comprise an elastic ratcheting system.

11. A ski boot according to claim 1, wherein:

said abutment is positionally adjustable on said shell base by means of an oblong element positionably mounted on a nipple fixed on said shell base.

12. A ski boot according to claim 1, wherein:

said positional adjustment of said abutment is a positional height adjustment.

13. A ski boot comprising:

a shell base having a heel zone;

an upper and a connection for enabling forward and rearward movement of said upper with respect to said shell base;

an abutment affixed to said shell base in said heel zone, said abutment being mounted for a positional height adjustment;

said upper being cooperable with said abutment for rear support of said upper with respect to said shell base and for retention of said upper during forward movement of said upper with respect to said shell base; and a movable element mounted for movement on said upper, said movable element being cooperable with said abutment to selectively latch said upper with respect to said shell base and to unlatch said upper during said forward movement regardless of said positional adjustment of said abutment; and a slot extending substantially vertically in a wall of said upper, said slot having an upper end and a lower end;

said abutment extending outwardly from said shell base and into said slot, said distance between said lower end and said upper end of said slot being greater than a dimension of said abutment to thereby allow for a relative displacement of said slot with respect to said abutment and, therefore, to thereby allow for a relative displacement of said upper with respect to said shell base, said upper end of said slot being in engagement with said abutment for constituting rearward support of said upper and, thereby, to define an advancement angle of said upper.

14. A ski boot according to claim 13, wherein:

said movable element comprises a portion made of a rigid material and a portion made of an elastically compressible material;

in said latching position, said rigid portion of said movable element extends between and is in engagement with said abutment and with said lower end of said slot, said rigid portion of said movable element thereby being in an active position and said elastically compressible portion being in an inactive position; and in said unlatching position, said rigid portion of said movable element is removed from engagement from said abutment and said elastically compressible portion of said movable element is positioned in engagement with said abutment, said elastically compressible portion thereby being in an active position.

* * * * *